United States Patent [19]

Long

[11] 4,058,709

[45] Nov. 15, 1977

[54] CONTROL COMPUTER FOR FUEL INJECTION SYSTEM

[75] Inventor: E. David Long, Elmira, N.Y.

[73] Assignee: Allied Chemical Corporation, Morris Township, N.J.

[21] Appl. No.: 629,443

[22] Filed: Nov. 6, 1975

[51] Int. Cl.[2] ..... F02M 51/00; G06G 7/66

[52] U.S. Cl. ..... 364/424; 123/32 EA

[58] Field of Search ..... 235/150.21; 123/32 EA, 123/117 R, 32 EB, 32 EC, 32 ED

[56] References Cited

U.S. PATENT DOCUMENTS

| | | | |
|---|---|---|---|
| 3,500,801 | 3/1970 | Long | 123/32 ED |
| 3,780,711 | 12/1973 | Lindberg | 123/32 EC |
| 3,809,029 | 5/1974 | Wakamatsu et al. | 123/32 EA |
| 3,820,198 | 6/1974 | Scofield | 123/32 EA |
| 3,834,362 | 9/1974 | Takeshita et al. | 123/32 EA |
| 3,854,458 | 12/1974 | Reddy | 123/32 EA |
| 3,858,561 | 1/1975 | Aono | 123/32 EA |
| 3,893,432 | 7/1975 | Krupp et al. | 235/150.21 |
| 3,914,580 | 10/1975 | Watson et al. | 123/32 EB |
| 3,923,031 | 12/1975 | Keranen | 123/32 EA |

*Primary Examiner*—Felix D. Gruber

*Attorney, Agent, or Firm*—Ernest D. Buff; Allen M. Krass

[57] ABSTRACT

A fuel injection system for multi cylinder engine employs a plurality of separate computing circuits for generating variable width control pulses to fuel injectors. Each channel actuates at least one fuel injector during more than 50% of an engine cycle. To derive the start times for these four pulses, a counter is advanced in timed relation to the operation of the engine by pulses from the ignition primary circuit. To control the phase of the firing pulses relative to the cycle time of the engine the counter is reset once each engine cycle by a pulse derived from one of the spark plug leads.

11 Claims, 16 Drawing Figures

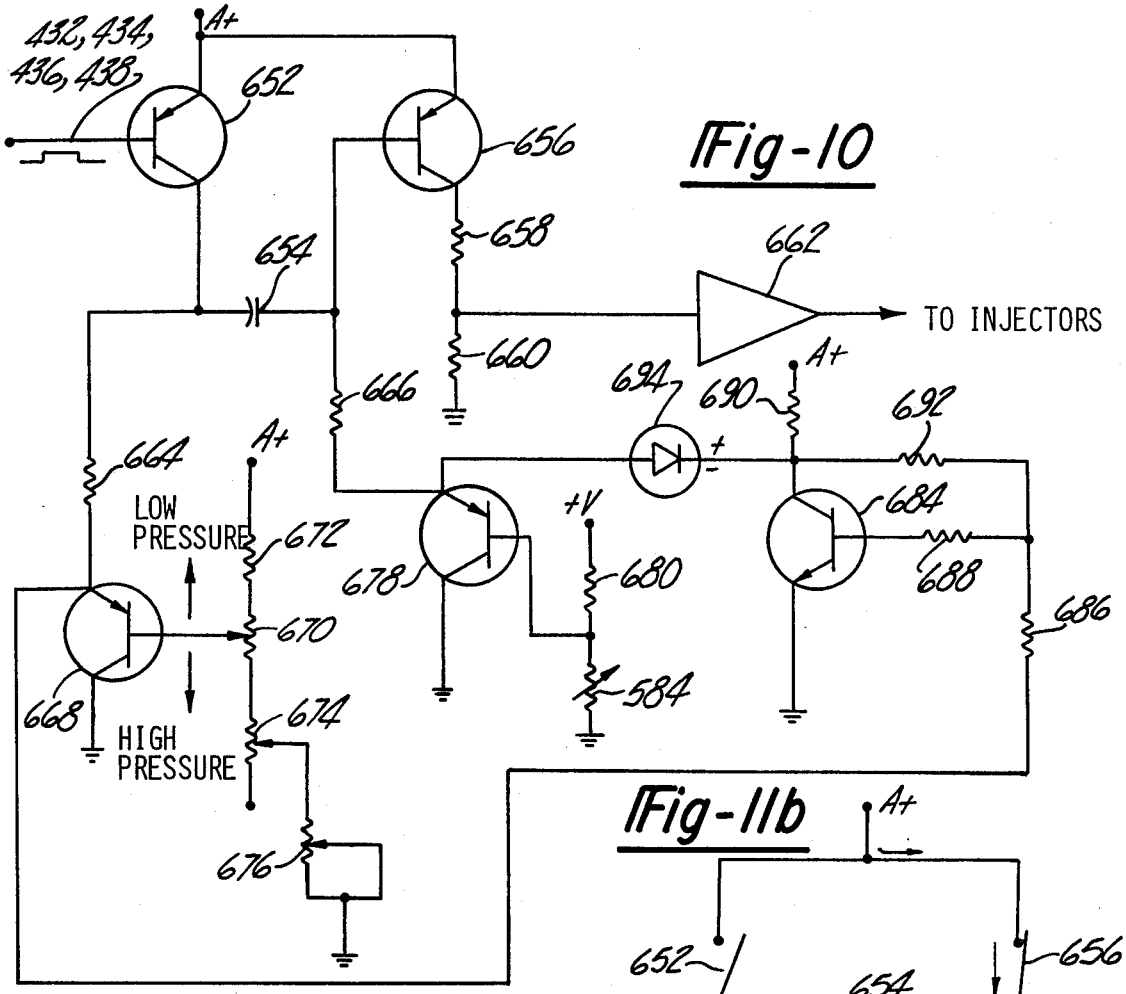
Fig-10
Fig-11b
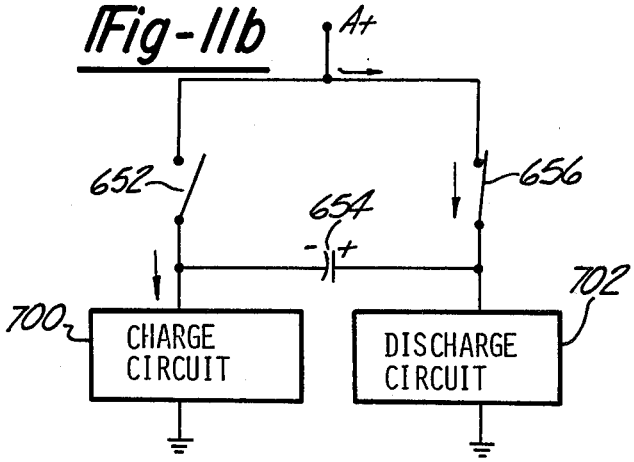
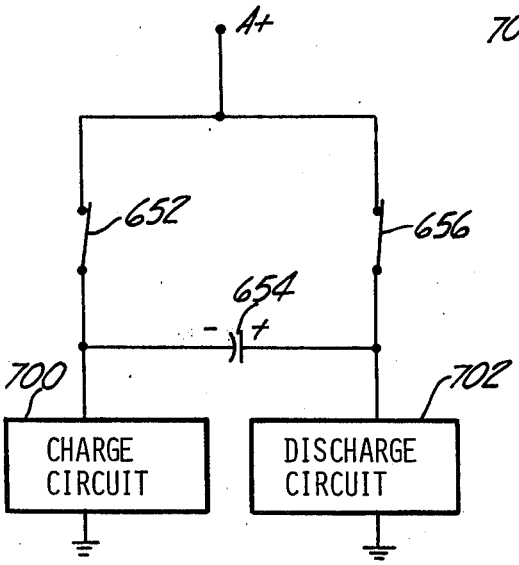
Fig-11a
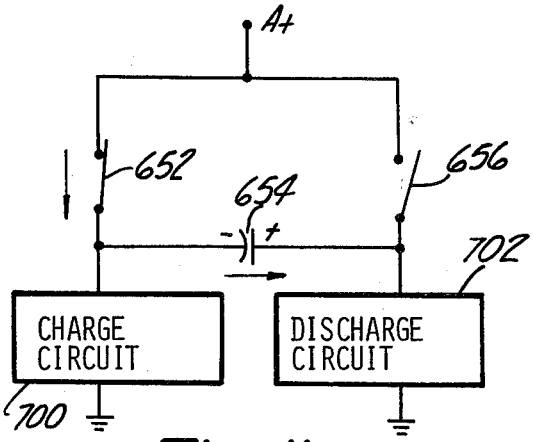
Fig-11c

CONTROL COMPUTER FOR FUEL INJECTION SYSTEM

BACKGROUND OF THE INVENTION

1. Field of the Invention

This invention relates to fuel injection systems for internal combustion engines and more particularly to a computer for controlling the time and quantity of injection of fuel to engine cylinders in synchronism with operation of the engine. This invention may be used in a system such as that described in my U.S. patent application, Ser. No. 629,421, entitled "Fuel Injection System" filed concurrently herewith on Nov. 6, 1975.

2. Prior Art

A fuel injection system for an internal combustion engine replaces a conventional carburetor with a number of fuel injectors. The injectors are connected to a pressurized fuel conduit and may be electrically energized to provide fuel from the conduit to their associated cylinders. The amount of fuel provided is a function of the pressure in the conduit and is proportional to the length of time for which the injector is actuated by the duration of an electrical control pulse.

In some early fuel injection systems, control pulses were provided sequentially to each of the injectors. Fully sequential systems have insufficient cycle time to perform the fuel metering function properly resulting in poor fuel economy and high exhaust emissions.

All known prior art fuel injection systems are limited by problems of: slow reaction time to changes in engine operating conditions, or insufficient cycle time for proper metering, or both problems. Both problems result from the single channel configuration of the fuel injection system. Single channel configuration requires the individual injectors to share available engine cycle time. For example, if engine cycle time is 20 milliseconds and four groups of injectors, each group having two injectors, are used, each group of injectors has less than 5 milliseconds of engine cycle time, that is, clearly less than 50% of cycle time. Later, control pulses were provided to all of the injectors simultaneously. It was found that simultaneous injection limits engine performance, that is, the speed of response to the engine to changes in operating parameters. For example, if the accelerator is suddenly depressed, the increased fuel charge called for by this action may not reach the engine for one or two engine cycles. In recent years, interest in fuel injection systems has centered about the prospect of minimizing the generation of pollutants in exhaust emission by metering the fuel provided to the engine more carefully than a carburetor. As a result, hybrid systems have been developed which are partially sequential, having the advantages and disadvantages of both systems.

SUMMARY OF THE INVENTION

The present invention relates to a control computer for metering fuel in a fuel injection system to provide a plurality of actuating pulses to injector means in timed relationship to one another and to the operation of the engine. The control computer includes a plurality of independent computing channels each operatively connected to at least one, different, fuel injector means. Each channel has a variable width pulse generator. Each channel is available for operation for a time duration which is equal to more than 50 percent of an engine cycle. Each channel is operatively connected to the same one injector means for substantially the entire engine cycle. The control computer also includes means for triggering each computing channel once per engine cycle during normal operation of the engine in timed relationship to the engine output rotation. For example, if engine cycle time is 20 milliseconds, and four groups of injectors, each group having two injectors, are used, each group has about 18 milliseconds of engine cycle time to remain activated, that is, more than 80% of engine cycle time and, specifically, about 90% of engine cycle time. The means for triggering, in the preferred embodiment, employs a counter which is incremented each time a firing pulse is applied to any of the engine's spark plugs. The individual computing channels are triggered by the various sequential outputs of this counter. The invention preferably incorporates means for phasing the counter once during each engine cycle to maintain a fixed phase relationship between the condition of the counter and the angular position of the engine output shaft rotation.

In a preferred embodiment of the invention, which will subsequently be described in detail, the fuel injectors are used in an eight cylinder engine. The fuel injectors are arranged in four groups of two each. The actuation of each group is controlled by an individual computing channel. This compromise between the expense of providing a separate computing channel for each injector, and the alternative of controlling all of the injectors at the same time from a single computing channel provides optimum control over the injection fuel metering function to give good engine response, good fuel economy and low emission of pollutants. A separate variable pulse width generator is provided for each computing channel. The pulse width generators receive outputs from engine parameter sensors which measure engine variables such as speed, temperature, pressure and the like, and generate pulses of a duration calculated to provide the engine cylinders with an appropriate quantity of fuel during each actuation of the injectors.

The four variable width pulse generators are triggered by four sequential outputs of a divide-by-eight sequential counter and decoder, incremented by pulses derived from the primary circuit of the engine ignition distribution system. These pulses are generated in time relation to the operation of the engine and eight pulses are generated during each engine cycle. Since only four computing channels are employed in this embodiment, this embodiment uses an eight-stage counter and the four variable width pulse generators are connected to separated outputs of the counter, i.e., outputs zero, 2, 4 and 6. Zero is used as an orbiting reference state.

The counter inherently returns to zero, the reference state, after it receives eight pulses. However, to lock the pulse generator into synchronism with a selected angle of the engine crankshaft, the counter is synchronized to the reference state once each engine cycle by a synchronizing pulse derived from a selected spark plug lead. This pulse occurs at the same time as a pulse derived from the primary of the spark coil, but the synchronizing pulse only occurs once in each engine cycle because of the distributor action.

Other advantages, applications and objectives of the present invention will be made apparent by the following detailed description of the preferred embodiment of the invention. The description makes reference to the accompanying drawings.

DESCRIPTION OF THE DRAWINGS

FIG. 10 is an electrical circuit diagram of a warm-up circuit which is a component of the control computer shown in FIGS. 1 and 4.

FIGS. 11A, 11B and 11C are electrical circuit diagrams of equivalent circuits of the pulse generator of FIG. 10, showing the circuit in three sequential modes.

DETAILED DESCRIPTION

Figure 1:
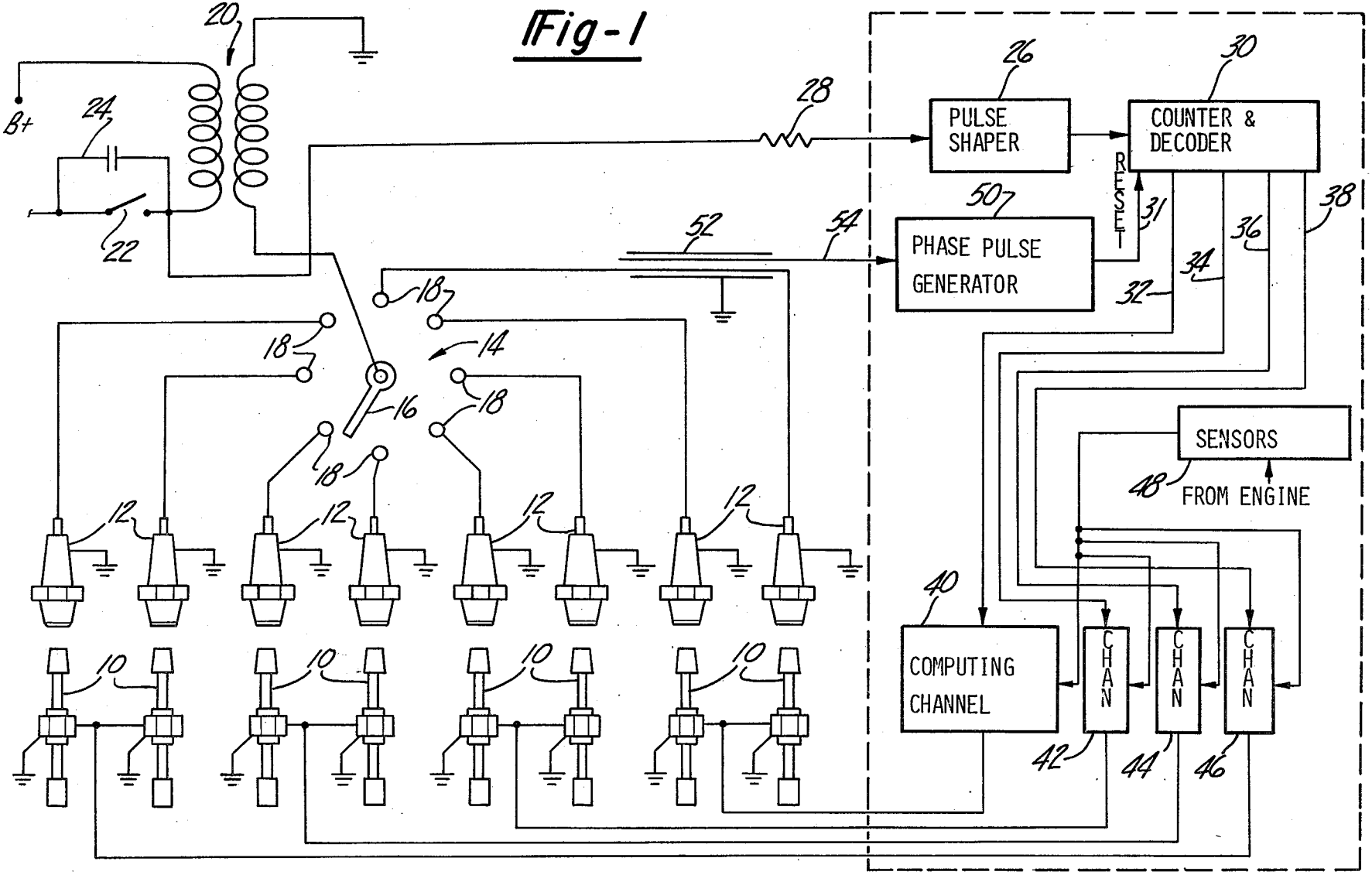
FIG. 1 is a schematic diagram of a fuel injection system embodying the control computer of the present invention.

Referring to FIG. 1, an eight cylinder engine employs one injector 10 associated with each cylinder. An injected fuel charge is admitted to the cylinder when the engine intake valve opens.

Each engine cylinder is also provided with a spark plug 12. The firing pulses for the spark plugs 12 are derived from an engine ignition distributor, generally indicated at 14. The distributor 14 is illustrated as a single-pole, eight-throw switch and could be implemented with a conventional mechanical distributor or with electronic circuitry. In either event, the contact of a common member 16 of the distributor 14 with terminals 18, which are connected to the spark plugs 12, is performed in synchronism with the rotation of the engine. The common element 16 makes one sweep of the terminals 18 for each engine cycle.

The voltage pulses for generating sparks across the spark plug gaps are derived from the secondary circuit of a spark coil, generally indicated by the numeral 20. The opposite end of the secondary circuit is grounded, as are the opposite terminals of the spark plugs 12. Application of current to the primary circuit of the spark coil 20 is achieved by breaker points 22, shunted by a capacitor 24. The breaker points 22 also operate in timed relation to the rotation of the engine. In alternative embodiments of the ignition system, the breaker points 22 and spark coil 20 could be replaced by suitable electronic apparatus.

To actuate the injectors 10 in timed relation to the operation of the engine and the firing of the spark plugs 12, a pulse shaper 26 is connected to the spark coil 20 primary circuit by a voltage limiting resistor 28. Each time the breaker points 22 open, i.e., eight times during each engine cycle, a voltage spike is applied to the pulse shaper 26.

The pulse shaper 26 differentiates, integrates, and clips the signal received each time the breaker points 22 open and close to produce a generally rectangular pulse. These pulses are provided to a means for triggering each computing channel which, in this embodiment, is a divider and an electronic incrementer, such as a divide-by-eight counter 30 which also has a decoder function. In this embodiment, the counter 30 and decoder includes a three-stage binary counter and associated circuitry for decoding the state of the counter 30 to provide outputs sequentially one one of four lines, 32, 34, 36 and 38. Such combined counter-decoder devices are commercially available in a variety of forms such as the CD4022CN integrated circuit manufactured by Motorola, Inc., and others. In other embodiments, the means for triggering each computing channel may be a rotating member driven by engine rotation and a plurality of stationary members, each stationary member connected is a different computing channel to provide synchronized pulses to the computing channels when actuated by the rotating member. The rotating member may be a single lobe cam mounted on the distributor shaft. The stationary member may be a switch or other mechanism, such as a pick-up coil, actuated by the rotating member. Assuming the counter 30 to be in a zero reference state initially, an output is provided on line 32. An output is provided on line 34 after two pulses have been received from the pulse shaper 26; an output on line 36 is provided when the fourth pulse is received; and an output on line 38 when the sixth pulse is received. The eighth pulse returns the counter to zero and again causes an output on line 32. Thus, one output is provided sequentially on each line 32, 34, 36 and 38 during each engine cycle wherein the breaker points 22 actuate eight times.

The pulses on output lines 32, 34, 36 and 38 are provided sequentially to four computing channels 40, 42, 44 and 46 respectively, each having a variable width pulse generator. These computing channels each have inputs from a group of engine parameter sensors 48 which sense various operating conditions such as manifold pressure, engine temperature, speed, throttle position and barometric pressure. The computing channels each include: a variable width pulse generator, intermediate pulse current amplifiers, high current drive means (such as amplifiers) connected to the injectors, and interface circuitry. The interface circuitry enable each of the computing channels to accept signals from common engine sensors with mutual interaction between channels. The computing channels also each include: a start-up circuit, a warm-up circuit and a constant current drive circuit, each of which is described subsequently herein. Upon receipt of a pulse on one of the input lines 32, 34, 36 or 38, the associated computing channel provides an output pulse having a pulse width which is determined by the outputs of the sensors 48.

The computing channel 40 is connected to one pair of injectors 10, and the computing channels 42, 44 and 46 are each connected to another pair of injector 10. An output pulse from one of the computing channels causes its two associated injectors 10 to actuate for the duration of the pulse width, injecting fuel into the intake valve area of the cylinders associated with those injectors 10. Assuming constant pressure of fuel in the injectors 10, the quantity of fuel injected is proportional to this pulse width. During a single engine cycle, the four groups of two injectors each provide fuel to their associated engine intake valves at timed intervals.

The counter 30 automatically returns to its zero reference state after eight counts. However, to insure that the counter 30 operates in the correct phase relationship with the rotation of the engine crankshaft and the distributor 14, and to prevent the counter from getting out of synchronism by virtue of some extraneous signal, a phase pulse generator 50 is connected to a reset input 31 of the counter 30 and receives input from a pulse detector pick-up 52 surrounded or connected to the lead to one of the spark plugs 12. Pick-up 52 simply consists of a conductive wire 54 supported in fixed parallel relation to a section of one of the spark plug leads. The section is enclosed in a metallic sheath which is grounded. Each spark plug 12 is fired by the distributor 14 once during each engine cycle. Accordingly the phase pulse generator 50 emits a reset pulse to the counter 30 once each engine cycle. This insures a proper phase relationship between the outputs of the counter 30 and the firing of the spark plugs 12.

Figure 2:
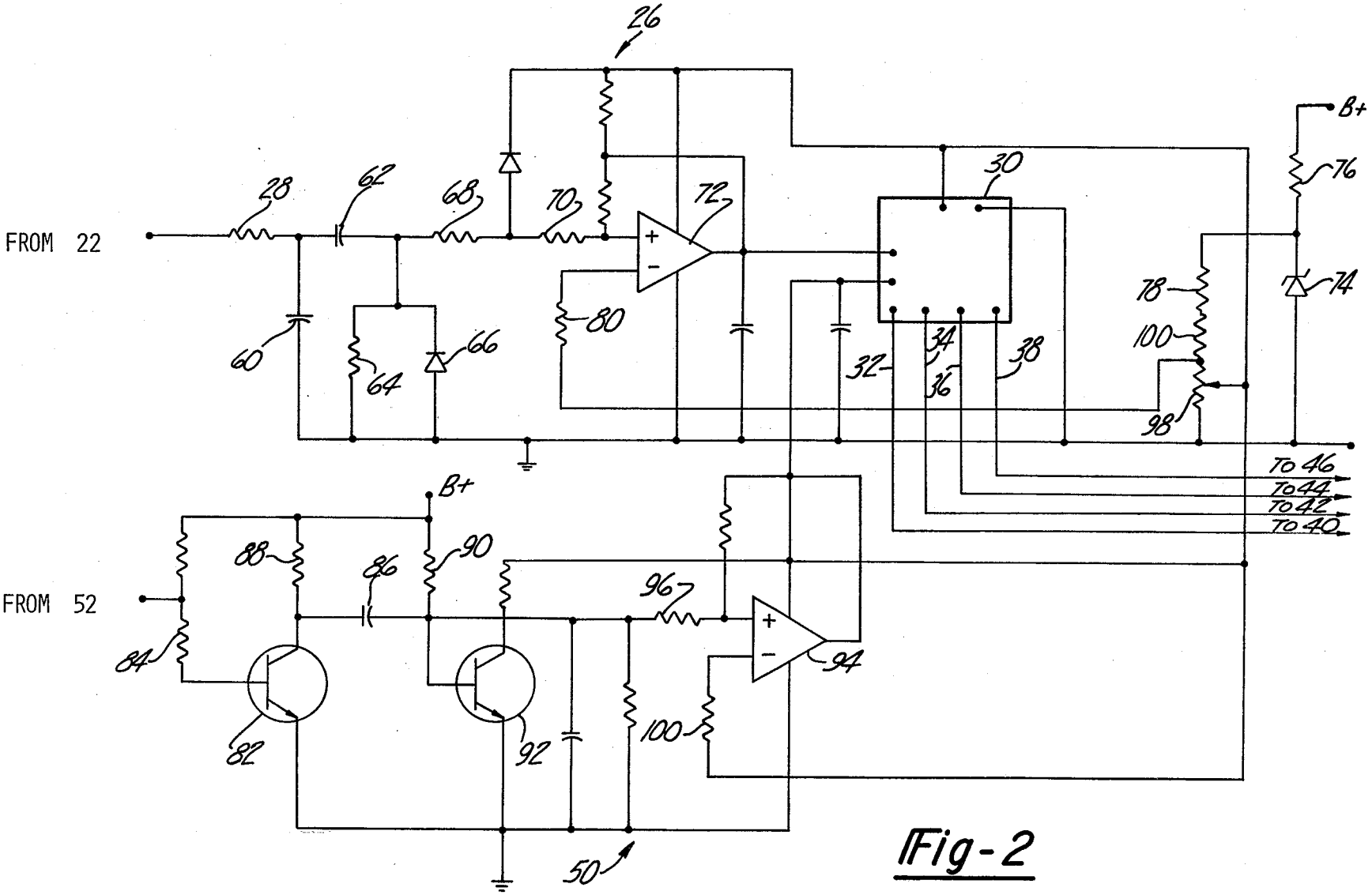
FIG. 2 is an electrical circuit diagram of a trigger circuit for a variable width pulse generator in the embodiment of FIG. 1.

The detailed circuit of a preferred embodiment of a pulse shaper 26 and a phase pulse generator 50 is disclosed in FIG. 2. The signals occurring across the breaker points 22 when they open are applied through the resistance 28 to an integrating capacitor 60. These signals are also differentiated by the combination of a capacitor 62 and a resistor 64. A diode 66 connected between the output of the capacitor 62 and ground clips any negative going components from the input signal. The resulting signal is coupled through a pair of resistances 68 and 70 to the positive input of a differential amplifier 72 connected in a comparative mode. The voltage at the negative terminal that the input at the positive terminal is compared against, is derived from a Zener diode voltage regulator 74 which is connected to the positive terminal of a voltage supply through a resistance 76. The Zener voltage is applied to the negative terminal of differential amplifier 72 through a pair of resistances 78 and 80. Accordingly, the differential amplifier 72 provides an output only when the conditioned pulse applied through the resistance 70 exceeds the regulated reference voltage through resistance 80. The output pulses from the differential amplifier 72 are supplied to the incrementing input of the counter 30 which is a four-place integrated circuit binary counter and decoding matrix. The four outputs of the counter 30, provided on lines 32, 34, 36 and 38, go high when the binary number represented by the four stages of the counter are in the 0, 2, 4 and 6 states respectively. These outputs are provided to the computing channels 40, 42, 44 and 46, respectively, and trigger the start of a actuating pulse for their associated injectors 10.

Considering the phase pulse generator, generally indicated at 50 in FIG. 2, pulses from spark plug lead pick up 52 are provided to the base of a transistor 82 through a resistance 84. The transistor 82, which has its emitter grounded, is biased so as to normally operate in the collector saturated region. A negative going pulse from the pick-up 52, applied through the resistor 84, will momentarily drive the base of the transistor 82 negative and cut-off conduction of the transistor 82. During this short cut-off period a capacitor 86 is charged through resistance 88. The time constant of capacitor 86 and resistance 88 is very short. After transistor 82 goes back into conduction, the capacitor 86 discharges through resistance 90, which is much larger than resistance 88. Accordingly capacitor 86 discharges slower than it charges. Therefore, capacitor 86 will take on energy during the negative going portions of the complex spark plug voltage upon initiation of the spark coil discharge and acts as an energy integrator for these negative going portions of the spark plug voltage. Soon after initiation of the spark plug voltage with which pick-up 52 is associated, transistor 82 goes back into conduction and capacitor 86 begins to discharge the previously accumulated energy through resistance 90. The capacitor 86 is connected to the base of a second transistor 92 which is normally biased into the collector saturated conduction. During the time period after receipt of a pulse from the pick-up 52, during which the capacitor 86 discharges its accumulated energy through resistance 90, the transistor 92 is cut-off and accordingly positive voltage is applied to a differential amplifier 94 connected in a comparative mode, through a resistance 96. The regulated comparator voltage for the amplifier 94 is derived from the Zener regulated voltage through resistances 98 and 100. The differential amplifier 94 thus provides an output whenever the voltage at the collector of transistor 92 exceeds its reference voltage. This pulse, which occurs for a short period of time following discharge through the spark plug lead sensed by pick-up 52, is supplied to the reset input of the counter 30, assuring the synchronization of the counter to the zero state, which normally should occur by virtue of the pulse applied to the incrementing input of the counter 30 through the pulse shaper 26.

Figure 3:
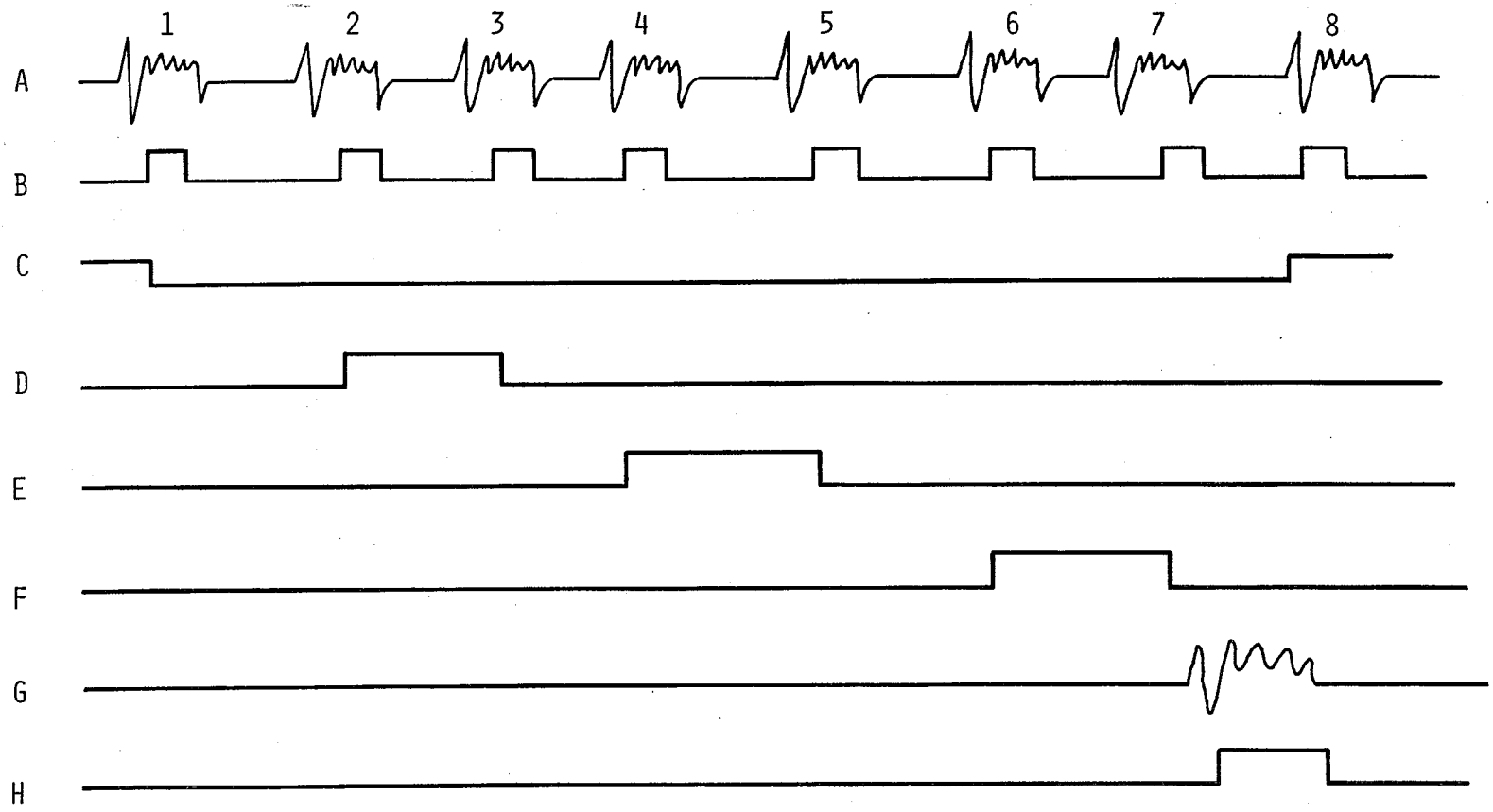
FIG. 3 is a plot of waveforms occurring at various points in the circuit of FIG. 2.

The waveforms occurring at various points in the circuitry of FIG. 2 during one complete engine cycle are illustrated in FIG. 3. FIG. 3A illustrates the eight voltage pulses received by the pulse shaper 26, through the resistance 28, from the spark coil primary, during an engine cycle. FIG. 3B illustrates the resulting, relatively noise-free pulses provided to the counter 30 by the signal conditioning circuitry 26 upon receipt of the spark coil primary. FIG. 3C illustrates the output on line 32 during the engine cycle. Assuming that the counter is initially reset to zero, the output on line 32 will be initially high, and then will go to zero when the first pulse is received from the pulse shaper 26. Similarly, FIG. 3D illustrates the output on line 34; FIG. 3E illustrates the output on line 36; and FIG. 3F illustrates the output on line 38. Each output is high once during each engine cycle for one-eighth of the cycle. FIG. 3G illustrates the output from the spark plug pick-up 52, which occurs once during each engine cycle and FIG. 3H illustrates the synchronizing pulse provided by the differential amplifier 94 in response to that spark plug pulse. This signal will normally occur in substantial synchronism to the eighth pulse from the pulse shaper 26 and acts to synchronize the counter 30 if the counter 30 is not in the zero reference state.

COMMON SENSOR CONNECTION

Figure 5:
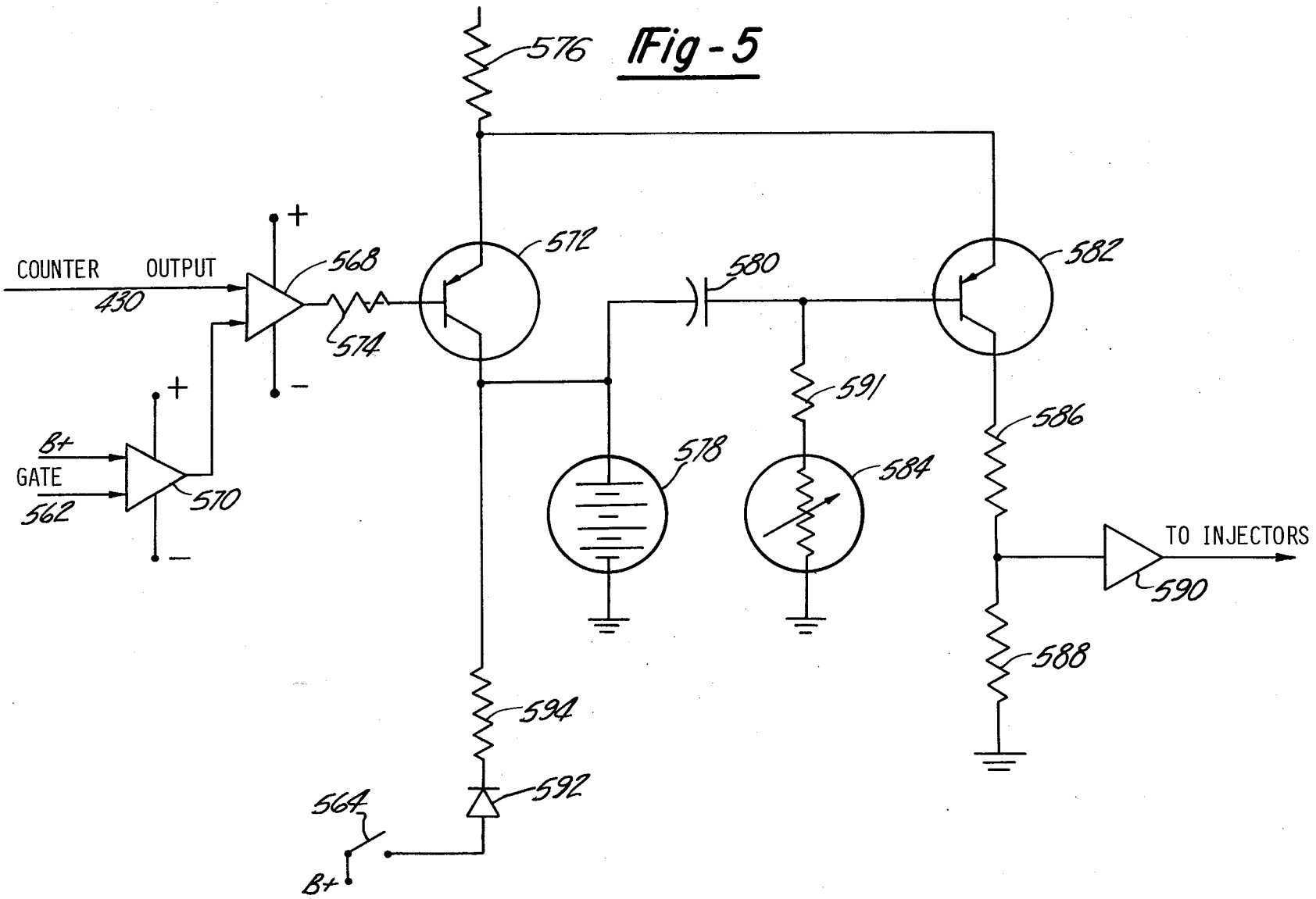
FIG. 5 is an electrical circuit diagram of a variable width pulse generator of the type used with the start-up circuit shown in FIG. 4.

All computing channels may be operatively connected in common to the engine parameter sensors. Referring to FIGS. 5 and 10, the engine sensors include the manifold pressure sensor 670 and the engine temperature sensor, which is the thermistor 584.

For manifold pressure sensing, the action of transistor 668 effectively isolates the manifold pressure sensor 670 from the variable width pulse generator operating currents associated with the collector of transistor 652, as reflected through resistor 664. Thus, a plurality of independent pulse generators, triggered at independent time intervals, may be connected in common to the emitter of transistor 668 without mutual interaction.

For engine temperature sensoring, the action of transistor 678 effectively isolates the temperature sensor 584 from the variable width pulse gnerator operating currents associated with the base of transistor 656, as reflected through resistor 666. Thus, a plurality of independent pulse generators, triggered at independent time intervals, may be connected in common to the emitter of transistor 678 without mutual interaction.

START-UP CIRCUIT

The injection time provided by prior art fuel injection systems may differ appreciably from those injection times which would make it easiest to start the automotive engine. During cold start-up, there is no emission advantage to injecting fuel with reference to a particular crankshaft angle. Further, the quantity of fuel injected during cold start-up is extremely critical if flooding, an overly rich or lean starting mixture with its attendant high levels of exhaust pollutants is to be avoided. The quantity of fuel to be injected to achieve quick start-up will vary principally with ambient temperature and the condition of the fuel, that is, the specific volatility of the fuel in the tank.

The quantity of the fuel injected into a cylinder during starting, based on the measurement of the normal engine operating parameters, may not be a proper amount to produce a fuel-air mixture in the cylinder for achieving flammability. The exact amount of fuel required to achieve this condition varies in a complicated manner as a function of a number of parameters including the exact air to fuel required ratio in combination with the volatility of the particular volume of fuel being injected. For these reasons, considerable difficulty may be encountered in starting the vehicle with a conventional fuel system.

The start-up circuit provides the injectors 10 with a series of shorter than normal electrical pulses spaced more frequently over the engine cycle. The start-up circuit of this invention substantially increases the starting speed compared to the prior art techniques of starting the engine with temperature modulated longer than normal fuel injection pulses which are used during normal running operation. The start-up circuit modulates discharge of fuel from the injectors 10 during start-up as a function of engine load, as well as engine temperature.

The technique of the present invention provides the fuel charge to each cylinder in a number of smaller portions spaced over the engine cycle has the effect of insuring that during the first turnover of the engine one or more cylinders will receive a fuel charge required for starting purposes. Consider the first cylinder to have its intake valve open after the injection system provides the first small fuel charge to the engine cylinder. This cylinder will receive a fraction of the total fuel charge. The cylinder that receives a charge after the next opening of the injection valve will receive twice that charge and so on during the first engine cycle. The last cylinder to receive a charge will receive the total charge. This technique effectively scans the air to fuel ratios provided to the various cylinders during the first engine cycle. As a result, some engine cylinders will receive a combustible air to fuel ratio for rapid start-up independent of absolute temperature and fuel properties.

The eight injectors 10 for the eight cylinder engine are arranged in groups of two. During normal running operation of the engine, the four groups of injectors 10 are fired in sequence, at spaced times over the engine cycle, by pulses derived from the counter 430 that is incremented each time a pulse occurs in the ignition system primary. The trigger pulses from the counter 430 are used to initiate pulses from variable width pulse generators that are controlled by sensors which sense the engine operating parameters and adjust the injector pulse widths as a function of those parameters. During the start-up operation only, each pulse from the counter 430 triggers all four variable width pulse generators 440, 442, 444 and 446 to actuate all injectors 10 simultaneously. The lengths of the injection pulses are decreased proportionately so that each cylinder receives the required total charge for start-up at the end of the engine cycle.

The variable width pulse generators 440, 442, 444, and 446 employ capacitors which are charged during the receipt of a triggering pulse from the counter 430 to a value dependent upon certain engine operating parameters. Upon termination of the trigger pulse from the counter 430, the capacitor discharges at a rate which is a function of certain other engine operating parameters. An output pulse for one of the groups of injectors 10 is generated during this discharge time. During starting, the voltage to which this capacitor is charged is limited so that the output pulse provided to the injector 10 has approximately one-quarter of the width of the pulse that would otherwise be provided to the engine at full throttle. This starting arrangement is highly effective and very economical to implement, requiring the addition of only a few low-cost electronic components to the fuel injection system 2.

Figure 4:
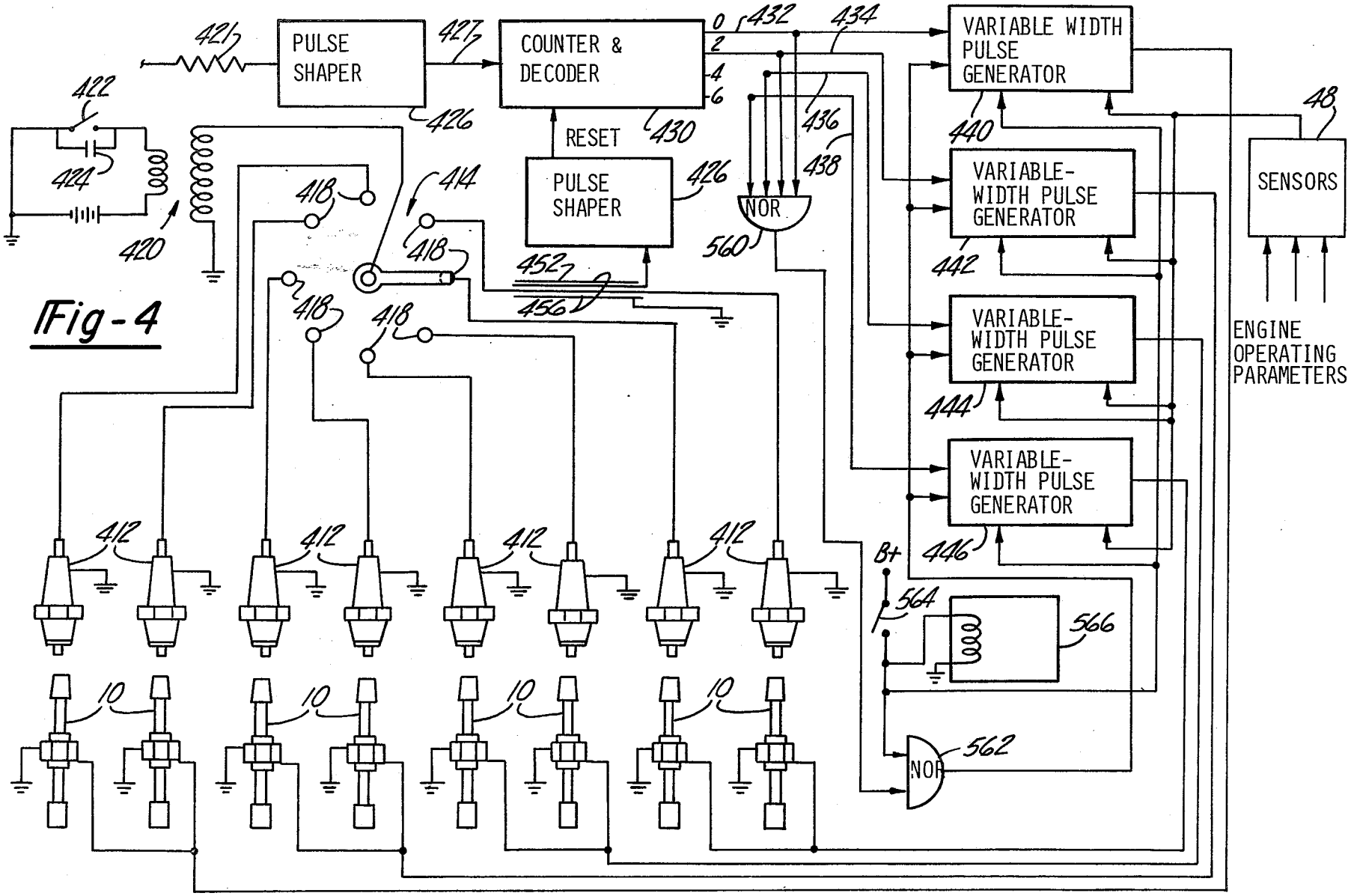
FIG. 4 is a schematic diagram of a portion of the fuel injection system showing a start-up circuit, which may be a component of the system shown in FIG. 1.

Referring to FIG. 4, the electronic control computer 19 preferably further includes: a start-up circuit for use during start-up of the engine. The start-up circuit generates a plurality of opening pulses to each injector 10 during each engine cycle during starting operation of the engine. After start-up and during normal operation of the engine, the computer 19 provides a single opening pulse to each injector 10 once during each engine cycle, as previously explained. Preferably, the start-up circuit is of the type described in my U.S. patent application Ser. No. 629,350 entitled "Start-Up Control for Fuel Injection System" filed concurrently herewith on Nov. 6, 1975.

The four outputs of the computer 19 are also provided to the four inputs of a first NOR gate 560. The output of the first NOR gate 560, which is normally high and goes low when any pulse is received at one of its inputs, is provided to a second NOR gate 562. The other input to the second NOR gate 562 is from the engine starter switch 564, which also provides power to the engine starter solenoid 566. The voltage relationship is such that the output of the second NOR gate 562 goes high when the starter switch 564 is closed and its other input goes low, indicating a high output on any of the four outputs of the counter 430.

The output of the second NOR gate 562 is provided to all four of the variable width pulse generators 440, 442, 444 and 446, and accordingly, triggers an injector actuating pulse from each of them. These pulses thus occur simultaneously during start-up. The starter switch 564 is also connected to each of the variable width generators 440, 442, 444 and 446 and acts to decrease the width of the pulse generated by them with respect to the pulse that would be generated, based on the output of the sensors 448, during normal operation. Accordingly, whenever the starter switch 564 is closed, each of the injectors 10 is actuated four times during each engine cycle and each opening time is shortened relative to the opening time during normal operation of the engine.

FIG. 5 illustrates the detailed construction of each of the four variable width pulse generators 440, 442, 444 and 446. The output of the counter 430 is applied to one input of differential amplifer 568 connected as a switch. The other input to the amplifier 568 is derived from the output of a second differential amplifier 570, also connected as a switch. One of the inputs to the amplifier 570 is connected to the positive terminal of the power supply and the other input is connected to the output of the NOR gate 562.

During normal operation of the engine, the output of the NOR gate 562 is low and the differential amplifier 570 provides a first level reference voltage to the differential amplifier 568. This reference voltage is at such a level that when the particular output of the counter 430 which is connected to that amplifier goes high, its output goes low and decreases the voltage applied to the base of a transistor 572, through resistance 574. When the output of NOR gate 562 goes low, the output of the differential amplifier 570 goes low and also causes a low output from the differential amplifier 568. Thus, a lowered voltage is applied to the base of the transistor 572 upon either the occurrence of a high output from the corresponding input of the counter 430 or a high output from gate 562 which occurs during starting, whenever any of the outputs of the counter 430 are high.

The emitter of transistor 572 is connected to the positive voltage supply through a resistance 576. Its collector is connected to ground through circuitry 578 which acts like a variable voltage source, and is schematically designated as such. The circuitry 578 is controlled by various engine operating parameters and in the preferred embodiment of the invention it is primarily a function of the manifold vacuum. In alternative embodiments, other combinations of parameters could be used to determine the voltage of the circuitry 578.

The collector of transistor 572 is also connected to one terminal of a capacitor 580 which has its other terminal connected to the base of a second transistor 582 and also to ground through a second variable voltage engine parameter sensor 584. In the preferred embodiment of the invention the engine parameter sensor 584 is primarily sensitive to engine temperature, and may constitute a thermistor, but other parameters may be selected for controlling the voltage of circuitry associated with sensor 584 in other embodiments of the invention. The emitter of transistor 582 is connected to the positive terminal of the power supply through resistance 576 and its collector is connected to ground through a pair of resistances 586 and 588.

In the absence of a negative going output from the differential amplifier 568, the transistor 572 operates in a saturated conduction region. Transistor 582 is also conductive and the voltage at the capacitor 580 is maintained equal to the emitter voltage of transistor 582. When the differential amplifier 568 provides a negative going pulse to the base of transistor 572, that transistor is switched out of conduction, allowing the capacitor 580 to charge to a voltage that is dependent upon the effective value of the manifold vacuum sensor circuitry 578 and the emitter voltage of transistor 582.

When the negative going pulse to the base of transistor 572 terminates, the transistor 572 immediately becomes conductive again and the voltage at the base of transistor 582 goes sharply positive by an amount proportional to the charge on the capacitor 580, turning off transistor 582. Capacitor 580 begins to discharge through the effective resistance 591 and the circuitry 584 at a rate dependent upon engine temperature. This discharge continues until the voltage across capacitor 580 reaches the emitter voltage of transistor 582, causing that transistor to turn on, and to clamp the voltage on capacitor 580 to a valve substantially equal to the emitter voltage of transistor 582.

The time during which transistor 582 is turned off is therefore dependent upon the manifold vacuum pressure, which controls the voltage to which the capacitor 580 charges during the off time of transistor 582, and to the engine temperature, which controls the rate at which the capacitor 580 discharges after transistor 572 again becomes conductive. An amplifier 590 is connected between the resistances 586 and 588 and the collector circuit of transistor 582 and provides a sharp, negative going pulse, having a width controlled by these factors, to the injectors 10 associated with that variable width pulse generator.

When the starter switch 564 is closed, the collector of transistor 572 is also connected to the positive supply voltage through a diode 592 and a resistor 594. This establishes a voltage level at the collector of transistor 572 which modifies the voltage to which the capacitor 580 charges during the off-time of transistor 572. Since manifold vacuum is essentially zero during starting, this voltage is such as to allow the capacitor 580 to charge to only about one-quarter of the voltage to which it would normally charge if the switch 564 were open. This decreases the width of the pulse produced by the circuit so that a fuel charge is distributed over the four pulses that an injector 10 receives in each engine cycle during starting.

Figure 6:
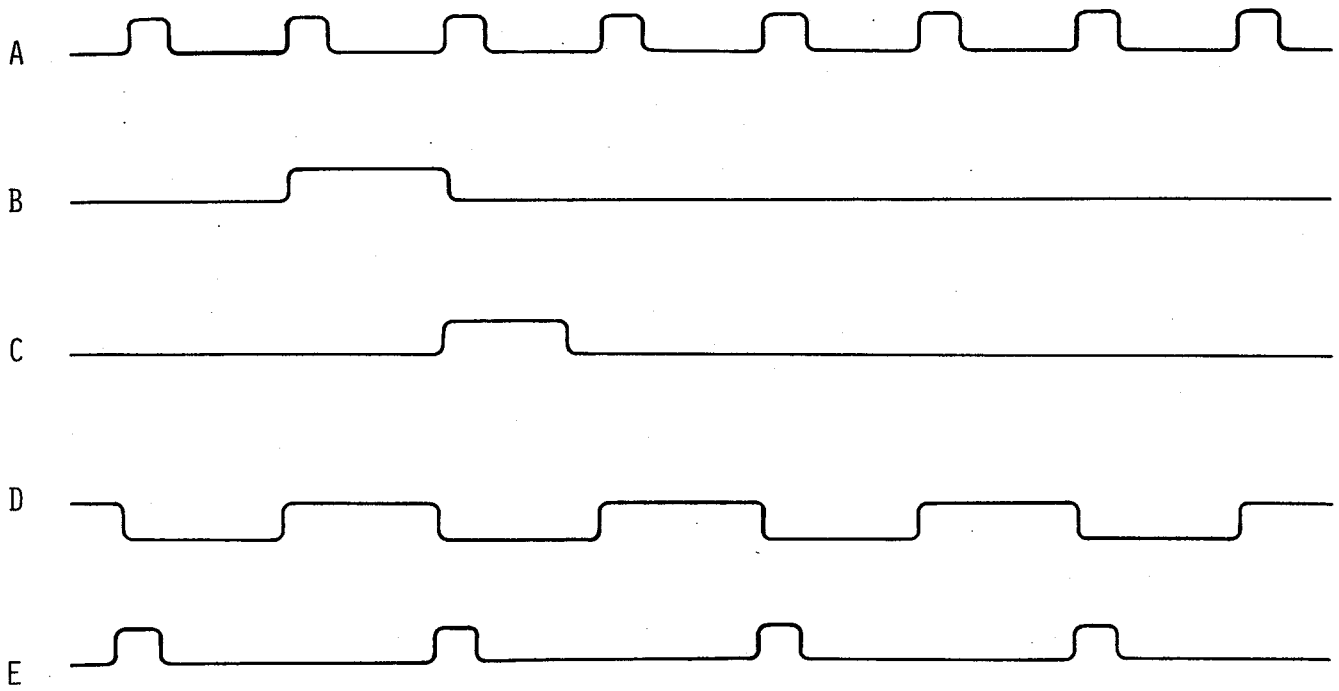
FIG. 6 is a plot of voltages appearing at various points in the start-up circuit of FIG. 5 during operation of the engine.

FIG. 6 illustrates the waveforms occurring at various points in the circuit of FIG. 1 during a full cycle of engine operation. Line A is a plot of the outputs of the pulse shaper 426 during one full engine cycle. The breaker points 422 open eight times during the engine cycle, providing eight outputs from the pulse shaper 426. Line B plots an output on one of the decoded counter 430 lines 432, 434, 436 or 438 during that engine cycle. The particular output goes high upon the receipt of the leading edge of one of the pulses from the pulse shaper 426 and returns to its low state upon receipt of the leading edge of the next pulse. It is high only once during the cycle. Line 21C illustrates the output of the variable width pulse generator controlled by the output of line B, during normal engine operation. Upon receipt of the trailing edge of the pulse on line B, the variable width pulse generator controlled by that line goes high and remains high for a period of time determined by the conditions of the outputs of sensors 448.

Line D plots the inputs received by all of the variable width pulse generators during starting of the engine. Effectively, the inputs of all of the four lines 432, 434, 436 and 438 are provided to each of the variable width pulse generators and accordingly each one receives four spaced pulses of the type illustrated on line B, during the full engine cycle. Line E plots the pulse outputs generated by each of the variable width pulse generators during starting operation in response to the input plotted on line D. Upon occurrence of the trailing edge of each of the pulses illustrated in line D, the output of each of the variable width pulse generators goes high and remains high for a period that is a fraction of the period of the pulse generated during normal operation of the engine, as illustrated in line C. Typically, the total width of the four output pulses from a variable width pulse generator during starting operation will equal the width of a single output pulse during normal operation with the other engine parameters being equal.

CORRECTION FOR INCIDENTAL SYSTEM VARIABLES

One source of inaccuracy in prior art fuel injection systems has resulted from incidental system variables, such as impedance variations of the injector solenoid coils 124 (FIGS. 7 and 8), specific resistance of the wire used in the individual coils 124 of different injectors 10 and the voltage supply to the fuel injection system. The coils 124 are positioned close to the engine. As a result their temperature and hence their resistance will vary between extremes ranging from a low when the engine starts cold in the winter and a high associated with normal engine operation. A temperature range from −20° to 300° F is not unusual for the injector coils. Such a variation in temperature will cause a wide variation in coil resistance.

Previous injector curcuits have employed switched outputs which provide a substantially constant voltage source and provide the solenoid coils with current inversely proportional to their resistance. Thus, the current to the coil, and the actuation force of the coil, would vary with the engine temperature. The response time required for the injector to actuate after the start of an actuating pulse is in turn a function of the current applied to the coil. Accordingly, this response time varies with engine temperature and limits the accuracy with which fuel can be metered by the system.

Figure 7:
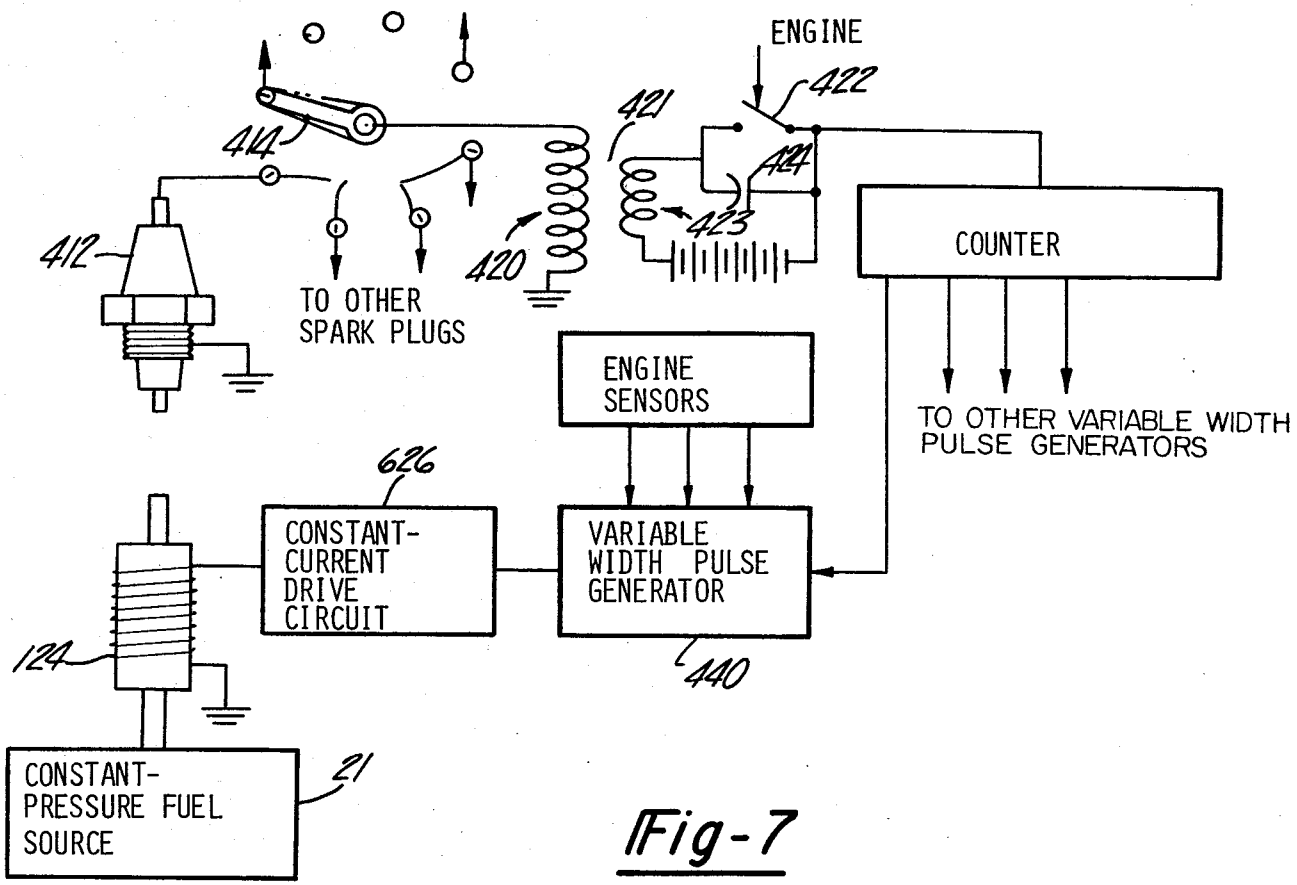
FIG. 7 is a schematic diagram of a portion of the fuel injection system showing a constant current drive circuit, which may be a component of the system shown in FIG. 1.
Figure 8:
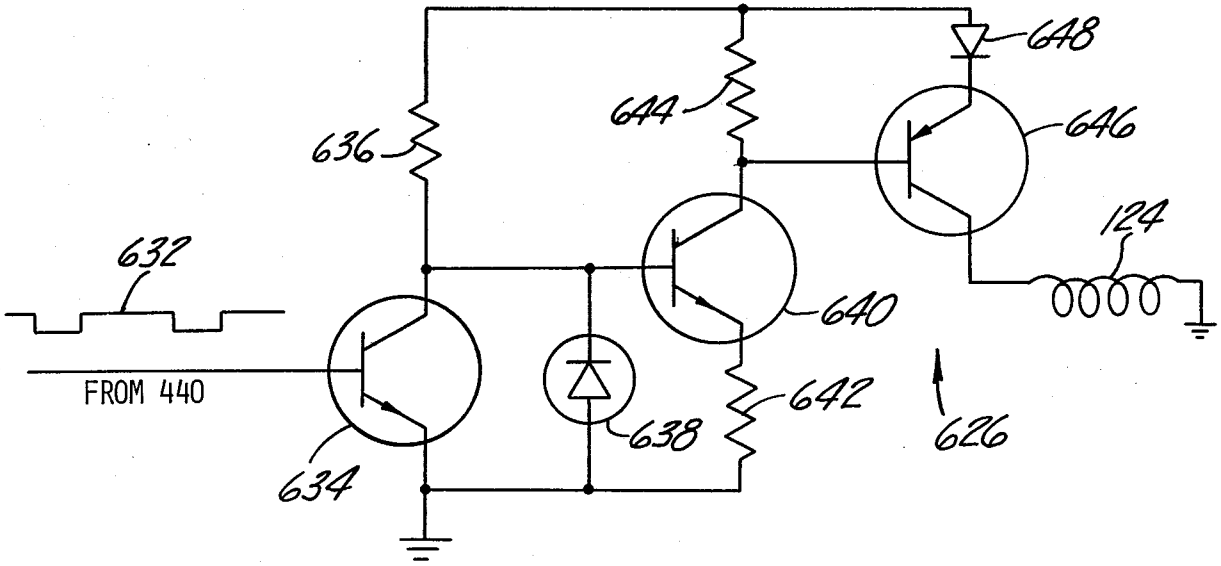
FIG. 8 is an electrical circuit diagram of the drive circuit shown in FIG. 7.
Figure 9:
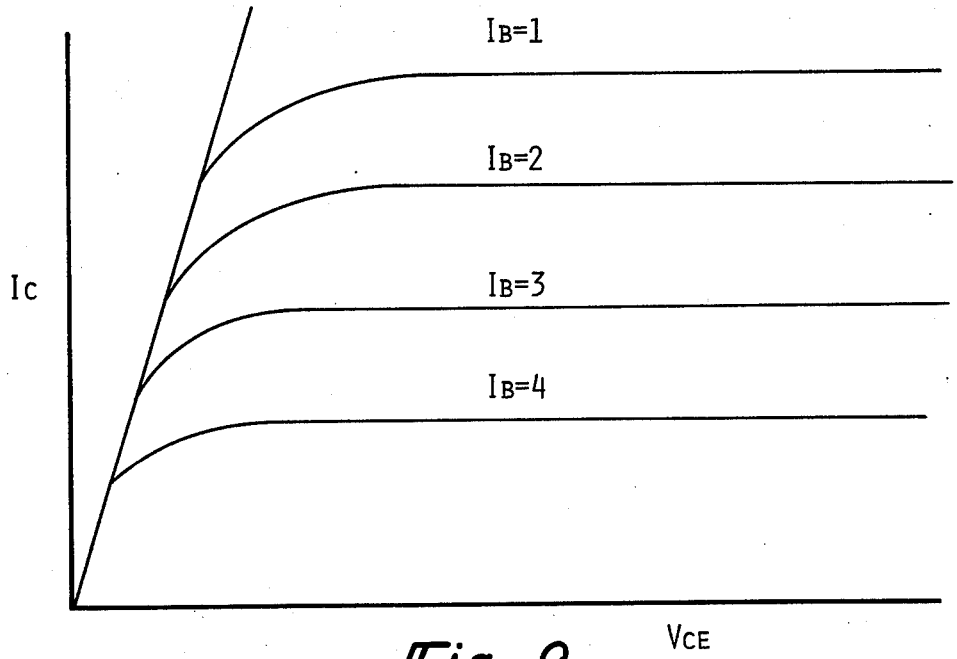
FIG. 9 is a plot of the characteristics of the transistor in the drive circuit output, illustrating the independence of output current from emitter resistance.
Figure 12:
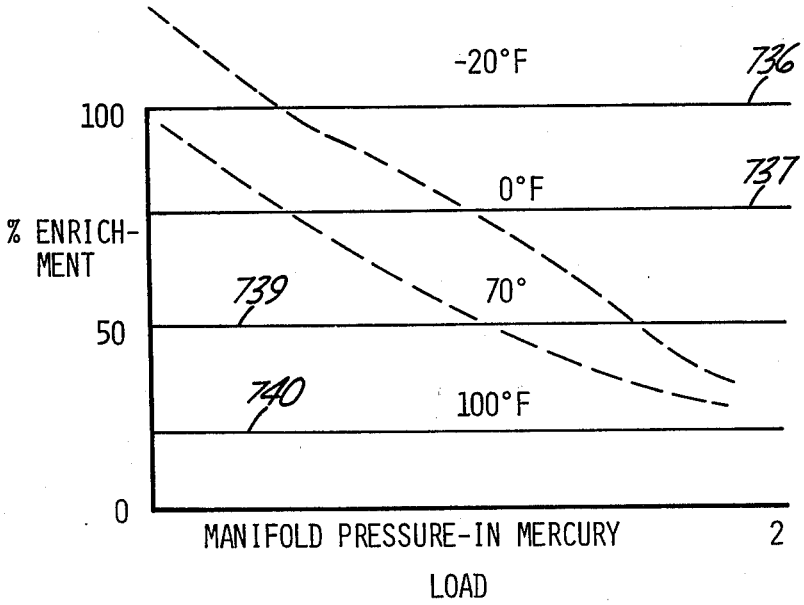
Fig-12 Prior Art
FIG. 12 is a plot of percent charge enrichment and pulse width as a function of load for varying temperatures with prior art system.

Referring to FIGS. 7, 8 and 9 the fuel injection system of the present may include a feature for applying a correction to the injector actuating pulse to correct for the effect of at least one incidental system variable on the effective response of the injector to the actuating pulse. The incidental system variables are: the impedance of the coil, the specific resistance of the wire used in the coil and the voltage supply to the fuel injection system such as that derived from the battery. Preferably a circuit for applying such correction is of the type described in my U.S. patent application Ser. No. 629,353 entitled "Fuel Injection System With Correction for Incidental System Variables" filed concurrently herewidth on Nov. 6, 1975. As a result variations in response time of the injector with engine temperature have been substantially reduced. In a preferred embodiment, which will subsequently be descrived in detail, such correction is achieved by driving the injector valve solenoid coil with a constant current circuit source switched into and out of a proportionately conductive mode by an output signal of a variable width pulse generator responsive to engine operating parameters. The constant current source includes an output transistor having the injector coil connected in its collector circuit and having its base driven by a switchable constant current input to the transistor. When the variable width pulse occurs and the current source is provided to its base, the transistor operates in a proportionately conductive mode, with its collector current being substantially independent of injector coil resistance. That is, the collector current is a function of base current but is substantially independent of collector load resistance. As the slope of the output transistor collector load line changes with variations in the impedance of the injector coil, the collector to emitter voltage inherently varies to maintain the collector current substantially constant. The constant current input to the base of the output transistor is supplied by an emitter follower having its input current stablilized by a Zener diode.

The constant current circuit is simple, reliable and renders the response time of the injector valves substantially independent of engine temperature and the incidental variables to allow more precise metering of the engine fuel. The output of the variable width pulse generator 440 is provided to a constant current driver circuit 626 operative to supply current to the coil 124 (FIG. 7) of a solenoid actuated injector valve 10 (FIGS. 1 and 4). The injector 10 is normally closed and opens upon receipt of an actuating pulse from the driver 626. The injector 10 is supplied with fuel from a constant pressure source 21 (FIG. 7) so that the quantity of fuel metered to an associated engine cylinder by the injector 28 is a function of the time that the injector 10 is held opened by the pulse from the constant current drive circuit 626. The drive circuit 626 maintains the response time of the injector 10 relatively independent of incidental system variables, such as resistance variations of the injector coil 124 resulting from temperature variations.

The detailed circuitry of the constant current drive circuit 626 is illustrated in FIG. 8. The variable width pulse generator 440 provides the circuit 626 with negative going pulses 632 of controlled width at regular intervals. These pulses 632 are provided to the base of an NPN transistor 634 having its collector connected to the positive terminal of a power supply through a resistance 636. The transistor 34 has its emitter grounded. Transistor 634 is biased to be conductive in the absence of a negative going pulse 632 at its base. A Zener diode 638 is connected across the emitter-collector circuit of the transistor 634. The voltage at the collector of the transistor 634 is normally at ground and rises to the break-down voltage of the diode 638 when a negative pulse 632 at the base of the transistor 634 switches it into non-conduction.

The Zener diode limited voltage appearing at the collector of the transistor 634 is applied to the base of a second NPN transistor 640.

The emitter of the NPN transistor 640 is connected to ground through a resistance 642. Its collector is connected to the positive terminal of the power supply through a resistance 644 and to the base of an output transistor 646. When the transistor 634 is switched into non-conduction, applying the regulated Zener voltage to the base of the transistor 640 the voltage across the resistance 642 rises to substantially the Zener voltage. The collector current of transistor 640 is substantially equal to its emitter current and both are highly stablilized by the action of Zener diode 638.

The collector current of transistor 640 is applied to the base of the PNP output transistor 646 having its collector connected to one end of the coil of the injector 10. The emitter of the transistor 646 is connected to the positive terminal of the power supply through a diode 648. In the absence of a relatively large current on the base of transistor 646, the diode 648 biases the transistor 646 into cut-off so that no current is applied to the solenoid coil of injector 124. When a negative going pulse 632 from the variable width pulse generator 440 cuts off transistor 634, and provides a stabilized current to the base of the transistor 646, transistor 646 is driven into a proportional conductive current mode. The resultant collector of transistor 646 current flows through the coil 124 of injector 10 and is precisely controlled as a function of the voltage of the Zener diode 638. When the negative going pulse 632 from the variable width pulse generator 440 terminates, the bias provided to the transistor 646 by the diode 648 drives transistor 646 sharply into non-conduction.

FIG. 9 is a plot of typical operating characteristics for transistor 646, illustrating the substantial independence of the collector current from variations in the collector to emitter voltage as a function of a particular base current.

The collector current is a function of base current and the collector-to-emitter voltage inherently varies in response to changes in the collector resistance caused by changes in impedance of the coil of injector 124 to maintain a constant current in the collector circuit. The transistor 646 acts as a constant current amplifier. With this configuration one end of the coil of injector 124 may be grounded.

WARM-UP CIRCUIT

Preferable, the present invention may also include a warm-up circuit which operates in conjunction with the variable width pulse generators 440, 442, 444 and 446 (FIG. 4). The warm-up circuit employs a unique mode of control based on the engine sensor output as well as a unique form of circuitry for achieving control of the pulse width as a function of the sensor output.

In previous fuel injection systems, as in carburetors, the quantity of fuel provided to the engine during each engine cycle was modified as a function of the manifold pressure or engine air flow which is a measure of the load on the engine during operation. As the manifold pressure is increased, the injection pulses were lengthened to provide a larger fuel charge to the engine cylinders. Since the degree to which this charge vaporizes and affects the actual air-fuel ration in the cylinder is a function of temperature, at cold engine temperatures, it is necessary to enrich the fuel charge. In a carburetor, this enrichment is achieved by a choke mechanism. In previous fuel injection systems, the pulse width was modulated as a function of engine temperature, but not as a function of manifold vacuum, to achieve the enrichment.

The prior art systems provided a constant percentage of enrichment independent of the load on the engine. This arrangement provided very adequate engine performance, but analysis of the engine exhausts have shown that it may provide an overly rich fuel-air mixture ratio at relatively low engine load conditions. In prior art port fuel injection systems, this overly rich ration results from the fact that the degree of vaporization of the fuel is not only temperature dependent, but is also dependent on the manifold pressure. At relatively low manifold pressures associated with low engine loads, the fuel charge is more readily vaporizable than at high manifold pressures.

The warm-up circuit of the present invention varies the degree of enrichment of the fuel charge not only during warm-up, but also at other times, as a function of load to provide a more correct air-fuel vapor ratio to the engine at all operating loads and temperatures. Preferably, the warm-up circuit is of the type described in my U.S. patent application Ser. No. 629,348 entitled "Fuel Injection System with Warm-up Circuit" filed concurrently herewith.

In a preferred embodiment of the warm-up circuit, which will subsequently be disclosed in detail, the pulse width is controlled primarily as a function of the engine manifold pressure and the engine temperature. The pulse width is generally controlled proportional to manifold pressure. As a lower manifold pressure is developed, the pulse time is shortened accordingly. Low manifold pressure is typically below atmospheric pressure and, thus, is a vacuum, sometimes referred to as manifold vacuum. Thus, lower manifold pressures are equivalent to higher manifold vacuums. The pulse time is also controlled as an inverse function of the engine temperature. At low temperatures, the pulse time is increased, enriching the fuel charge. The percentage of enrichment is decreased with increasing temperature.

The warm-up circuit also provides for modulation of the temperature-dependent enrichment. The modulation diminishes the enrichment in inverse proportion to engine load. When the manifold pressure is relatively high, such as occurs during acceleration or start-up of the engine, the full temperature enrichment factor is provided to the engine. As the load decreases, decreasing the manifold pressure, the temperature-dependent enrichment factor is diminished. The modulation compensates for the higher degree of evaporation of the fuel at low manifold pressures.

The warm-up circuit includes: a pressure receiving means for receiving an intake manifold pressure signal from a first sensor; a temperature receiving means for receiving an engine temperature signal from a second sensor; and a means for generating a modulated warm-up signal to a pulse generator when the engine temperature is below a predetermined level. The modulated warm-up signal is a function of said manifold pressure signal and said temperature signal.

The modulated warm-up signal varies directly as a function of manifold pressure and inversely as a function of engine temperature. The temperature signal is modulated by the pressure signal to produce said warm-up signal. The predetermined level corresponds to substantially maximum evaporation of the injected fuel in the engine. The means for receiving the pressure signal and the means for receiving the temperature signal generate a modulated warm-up signal which is substantially identical to the temperature signal at engine temperatures above the predetermined level.

The variable width pulse generator 440, 442, 444 and 446 employ a capacitor and circuitry for charging the capacitor to a voltage proportional to a manifold pressure signal. The trigger pulse disconnects the capacitor from its charging source and connects it to a discharge path having an effective resistance controlled by a temperature sensor and the manifold pressure modulating signal. The output pulse from the circuit starts when this switching occurs and continues until the capacitor discharges to a predetermined voltage. Considering the plot of capacitor charge and discharge, the height of the curve, i.e., the maximum value to which the capacitor is charged, is a function of manifold pressure. The rate of discharge of the capacitor is a function of the engine temperature together with the manifold pressure modulation. The discharge time is proportional to manifold pressure and the combination of engine temperature and the manifold pressure modulating signal.

The switch that is employed with the preferred embodiment consists of a pair of transistors. Both are normally conductive and in this state effectively short the two ends of the capacitor. The first switch opens upon receipt of a trigger signal from a counter and creates a charging path for the capacitor. After the trigger pulse terminates, the first transistor closes and connects the negatively charged end of the capacitor to the second transistor, biasing that transistor into a non-conductive mode. This allows the capacitor to discharge through a second resistance. The discharge path of the capacitor is effectively controlled as a function of the engine temperature and manifold vacuum modulation. This discharge continues until the capacitor charge falls to a point at which the second transistor returns to conduction, effectively clamping the voltage on the capacitor. An output circuit provides the injector with a control pulse during this sharply defined capacitor discharge period. The pulse width control system of the present invention is highly effective and extremely simple in construction.

The fuel injection system employing variable width pulse generators 440, 442, 444 and 446 and a warm-up modulation circuit is broadly illustrated in FIGS. 1 and 4. The timing signals for the injector pulses are derived from the vehicle's ignition system which employs a spark coil 420 having engine actuated breaker points 442, shunted by a capacitor 424, connected in the primary circuit 420 of the spark coil 420. The secondary circuit of the spark coil 420 is connected to a common arm of a distributor generally indicated at 414. The engine spark plugs 412 are connected to the output terminals 418 of the distributor 414.

The electrical signals generated each time the breaker points 422 open are applied through a resistor 421 to a pulse shaping network 426. The square wave outputs of the pulse shaper 426 generated each time the breaker points 422 open, are provided through a line 427 to a counter 430 which has a decoder circuit. The counter 430 is incremented each time it receives a pulse from the pulse shaper and the decoder portion provides outputs sequentially on lines 432, 434, 436 and 438 as the counter 430 state advances. An output may be provided on line 432 when the count is 0; an output on line 434 when the count is 2; and output on line 436 when the count is 4; and an output on line 438 when the count is 6.

These lines are connected to four variable width pulse generators 440, 442, 444 and 446. Each of the pulse generators also receives an input from a group of sensors 448 associated with the engine. Each time one of the pulse generators receives a signal from the counter on its input line, it provides an output pulse having a duration which is a function of the outputs of the sensors 448.

The pulse generator 440 is connected to the actuating solenoid of one pair of fuel injectors 10. The pulse generator 442 is connected to another pair of injectors 10; the pulse generator 444 is connected to another pair of injectors 10; and the pulse generator 446 is connected to a pair of injectors 10. In alternative embodiments of the invention, all of the fuel injectors could be energized simultaneously from a single variable width pulse generator or a separate variable width pulse generator could be provided for each injector. The preferred arrangement is to actuate two injectors simultaneously from a single variable width pulse generator.

FIG. 10 schematically illustrates one of the variable width pulse generators 440, 442, 444 or 446, which may be substantially identical, and the associated sensors 448. Referring to FIG. 10, the positive input pulses provided on the trigger lines 432, 434, 436, or 438 are fed to the base of a PNP transistor 652 having its collector connected to one terminal of a capacitor 654. The other terminal of the capacitor 654 is connected to the base of a second PNP transistor 656. The emitters of the two transistors 652 and 656 are connected to a positive voltage source. The collector of transistor 656 is connected to ground through resistors 656 and 660, and the mid-point of those resistors is connected to an output driving amplifier 662. The driving amplifier 662 may be of the type disclosed in my copending application, Ser. No. 629,353, entitled "Fuel Injection System with Correction for Incidental System Variables," filed concurrently herewith on Nov. 6, 1975, which in one embodiment provides constant actuating current to the injectors, during the pulse time, independent of variables such as impedance of a solenoid in the injectors as a result of variations in engine temperature, specific resistance of the wire used in solenoid coil, and variation in the voltage supply in the fuel injection system.

In a quiescent state, biases on the transistors 652 and 656 are such that they are normally both conductive. Thus, both ends of the capacitor 654 are at substantially the same potential and no appreciable charge is stored on the capacitor 654. When a positive pulse is applied to the base of the transistor 652 from the counter 654, transistor 652 is switched into non-conduction. The capacitor 654 then charges through a path that includes the base-emitter of transistor 656, the resistance 664, and circuitry associated with the resistance 664, which will be described subsequently. During this time, the transistor 656 remains conductive. Capacitor 654 charges with a negative potential on its end connected to the collector of transistor 652.

When the positive pulse to the base of the transistor 652 terminates, transistor 652 returns to its conductive mode. The charge on the capacitor 654 is coupled through the collector-emitter circuit of transistor 652, through the collector-emitter circuit of transistor 678 and through resistor 666. The base of transistor 656, driving transistor 656 into a non-conductive state. Capacitor 654 then begins to discharge. The rate of this discharge of the capacitor 654 is dependent upon the initial charge placed on the capacitor 654 and effective resistance of the discharge path. This discharging action continues until the sum of the voltages induced across discharge resistor 666 by the discharging action of capacitor 654 and the collector-emitter voltage of transistor 678 results in a voltage at the base of transistor 656 sufficient to forward bias the base-emitter junction of transistor 656, at the instant the base-emitter junction of transistor 656 becomes forward biased, the discharging action of capacitor 654 will cease and transistor 656 will return to the conductive state. Thus, the time during which transistor 656 is rendered non-conductive is determined substantially by the charge placed in capacitor 654 while charging, as well as the effective resistance of the discharging path for capacitor 654 while discharging.

The pulse applied to output driver 662 during the time that the transistor 656 is non-conductive represents the output pulse from the system. The voltage to which the capacitor 654 is charged is controlled by a PNP transistor 668 having its emitter connected to the capacitor 654 through the resistance 664. The collector of transistor 668 is grounded and its base is connected to a variable point of a potentiometer type manifold pressure sensor 670. One end of the sensor 670 is connected to a positive terminal of a voltage source through a resistance 672. The other end of the manifold pressure sensor 670 is connected to ground through a pair of resistances 674 and 676, The resistance 674 is an idle adjustment rheostat and the variable resistance 676 is a barometric pressure actuated bellows device.

The variable terminal on the manifold pressure sensor 670 is moved toward its positive end as the pressure decreases. This increases the voltage on the base of transistor 668. Transistor 668 is connected in an emitter follower configuration and, thus, the voltage at its emitter substantially follows the voltage at its base. Thus, decreasing manifold pressure raises the voltage at the bottom of resistance 664 so that the net potential difference between the base of transistor 656 and the opposite end of capacitor 654 decreases as the manifold pressure decreases. This decreases the charge applied to the capacitor 654 during the off time of transistor 652.

The discharge path for the capacitor 654 includes the PNP transistor 678 having its emitter connected to the opposite end of the resistance 666 from the capacitor 654. The base of transistor 678 is connected to ground through a thermistor 584, supported on the engine so as to measure engine temperature and connected to a positive voltage source through a resistor 680. The thermistor resistance decreases with increasing temperature. The collector of transistor 678 is grounded through a resistance 682 so that the voltage at the emitter of the transistor 678 varies in reverse relation to the temperature of the engine, decreasing as the engine warms up as the thermistor 584 lowers in resistance. Since the voltage level to which capacitor 654 must discharge depends in part upon the collector to emitter voltage of transistor 678 before transistor 656 can be forward biased, as a result, a decreasing collector-emitter voltage of transistor 678 resulting from a decreasing resistance of the thermistor 584 will decrease the time required for the capacitor 654 to discharge to a voltage across resistor 666 to forward bias transistor 666.

Thus, so long as transistor 678 is rendered operable, the duration of the output signal to the injectors from amplifier 662 will vary as on reverse function of thermistor 584 which senses engine temperature. The modulation of the fuel enrichment charge as a function of the engine load, is controlled by a modulating PNP transistor 684 having its base connected to the emitter of the manifold pressure emitter-follower transistor 668 through resistance 686 and 688. The emitter of transistor 684 is grounded and its collector is connected to a positive voltage source through a resistor 690. A resistor 692 connects the collector transistor 684 to the junction of resistors 686 and 688.

The collector of the modulating transistor 684 is connected to the emitter of transistor 678 through a diode 694. The emitter-collector circuit of the transistor 684 through the diode 694 will modulate the voltage at the emitter of transistor 678 as an inverse function of manifold pressure.

The amount of enrichment modulation obtained is a function of the magnitude of manifold pressure change and the circuit constants associated with modulating transistor 684. When the manifold pressure is high, the base circuit of the transistor 684 is near ground potential and transistor 684 is turned off, reverse biasing the diode 694 and allowing transistor 678 to become substantially unmodulated. As manifold pressure decreases, the base of transistor 684 becomes more positive and, when amplified by transistor 684, the resulting modulating signal is coupled through diode 694. At some predetermined low manifold pressure, the effective collector-emitter resistance of transistor 684 may become low enough to effectively ground the emitter of transistor 678. That simulates a decrease of resistance of the thermistor 584, effectively modulating enrichment. As the engine reaches a predetermined operating temperature, transistor 678 may become sufficiently conductive to substantially short-circuit resistor 666 to ground reference potential and there is no further enrichment and no modulation thereof.

Other embodiments could have the manifold pressure signal function having an inverse pressure output signal relationship in the discharge circuit of capacitor 654 and the modulating warm-up signal derived from a temperature sensor in the charge circuit of capacitor 654. The capacitor 654 is a voltage storage means. Other embodiments having different circuitry could use a current storage means, such as an inductor.

FIGS. 11A, 11B and 11C illustrate an equivalent circuit of the system for three modes of operation. Transistors 652 and 656 are illustrated as switches and the omponents associated with the collector of transistor 652 are termed a charge circuit 700 while the components associated with the base of transistor 656 are termed a discharge circuit 702.

In the absence of a pulse at the base of the transistor 652, as illustrated in FIG. 29A, both transistors are conductive and there is no potential stored in the capacitor 654. As illustrated in FIG. 29B, when a pulse is received at the base of 652 that opens and allows the capacitor to charge through the transistor 656 and the charge circuit 700. As illustrated in FIG. 29C, after the pulse to the base of the transistor 652 terminates, the negative charge on the capacitor causes transistor 656 to open creating a discharge path through transistor 652 and the discharge circuit 702.

Figure 13:
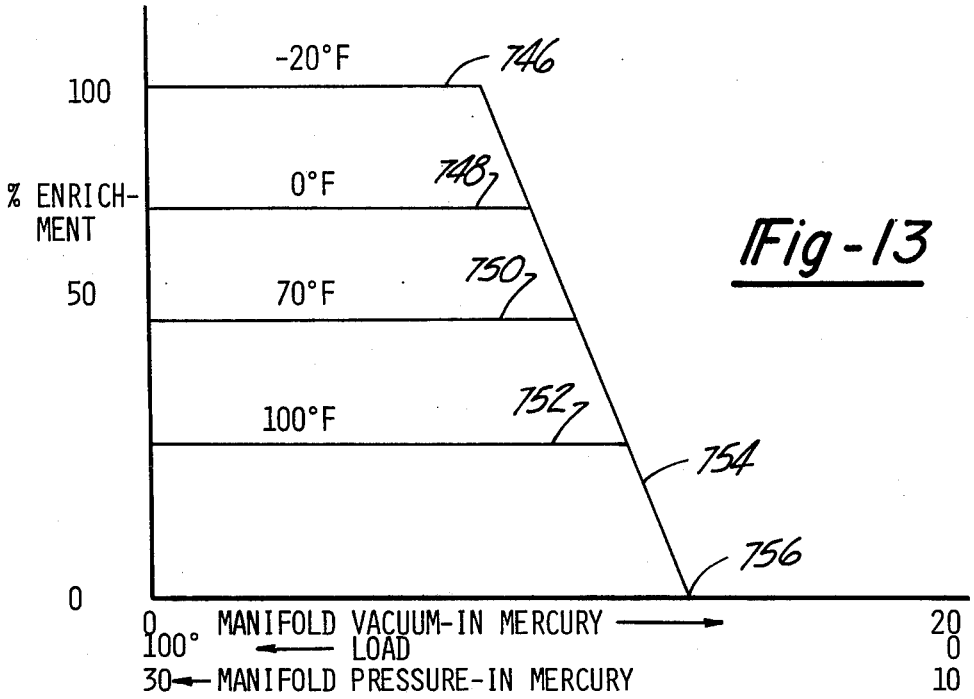
FIG. 13 is a plot of percent enrichment as a function of load for the pulse generator of FIG. 10.

To further illustrate the prior art operation of enrichment as a function of temperature and load, FIG. 13 is a plot of the percentage enrichment for different temperatures as a function of manifold pressure for prior art systems lacking modulation of enrichment. Line 736 typically represents the percentage enrichment provided at −20° F; line 738 typically represents the percentage enrichment provided at 0° F; line 739 typically represents the percentage enrichment at 70° F and line 740 typically represents the percentage enrichment at 100° F. While the pulse width increases as engine load increases, the percentage of enrichment remains constant independent of manifold pressure and load.

Figure 14:
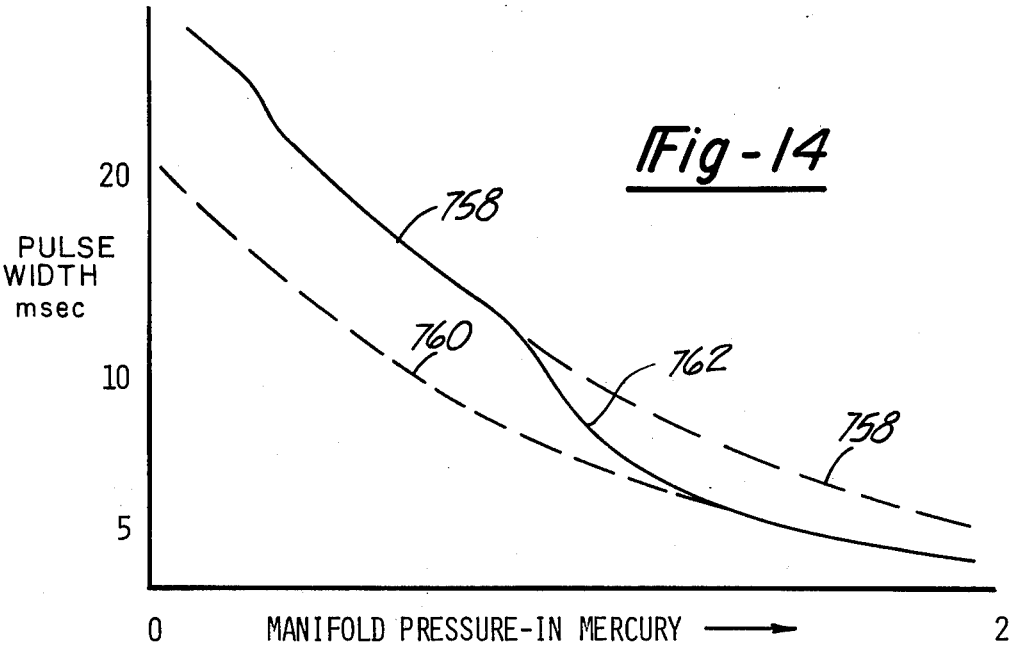
FIG. 14 is a plot of pulse width as a function of load for the pulse generator of FIG. 4.

FIG. 14 is a plot of the percentage enrichment of the fuel charge, as a function of load, achieved with my invention. Lines 746, 748, 750 and 752 represent the percentage enrichments for −20° F, 0° F, 70° and 100° F respectively. At all temperatures with relatively high loads, the amount of enrichment is initially a constant percentage; typically the same percentage indicated by the enrichment lines of the prior art in FIG. 13. At a predetermined lower manifold pressure, percentage enrichment begins to decrease with decreased pressure. In terms of the circuit of FIG. 10, this results from the fact that the lower predetermined manifold pressure begins to forward bias diode 694 thereby beginning to limit the voltage at the emitter of transistor 678 derived from the action of thermistor 584. The percent of enrichment curves in FIG. 14 then become concurrent, on line 754 until point 756 is reached, at which the transistor 684 is sufficiently conductive to fully override the enriching effect of the transistor 682.

FIG. 15 is a typical representation of the pulse width in milliseconds as a function of manifold pressure for a cold engine without the modulation feature (line 758); a hot engine without the modulation feature (line 760) and a cold engine with the modulation feature (line 762). Line 762 representing the pulse width of the engine with the enrichment feature follows the curve (line 758) of the conventional cold engine at high manifold pressures, then goes through a transition stage until it joins the curve (line 760) of the hot engine at low manifold pressures.

I claim:

1. A control computer for metering fuel in a fuel injection system for an engine having a plurality of fuel injection means, an ignition system with primary and secondary circuits operative to generate a sequence of ignition pulses, an engine cycle time, a rotating output shaft, and at least one engine parameter sensor, said computer comprising: a plurality of independent computing channels each operatively coupled to at least one common engine parameter sensor and each operatively coupled to at least one separate fuel injector means, each channel having a variable width pulse generator, each channel available for operation for a time duration which is equal to more than fifty percent of an engine cycle, each channel operatively coupled to its separate injector means for substantially the entire cycle; and a common trigger means having a single input connection from the primary of the ignition system and separate output connections to each of the computing channels operative to sequentially trigger each computing channel once per engine cycle during normal operation of the engine in timed relationship to the engine output rotation.

2. The control computer of claim 1 wherein said common trigger means comprises: a counter and decoder.

3. The control computer of claim 2 wherein the injector means are arranged in groups, and the control computer includes output connections between and the control computer includes output connections between each computing channel and one of the groups whereby the groups receive independent injection pulses.

4. The control computer of claim 2 wherein said engine has engine cylinders, and the ignition system includes a spark coil and spark plug fuel ignitors, and wherein said trigger means includes means for sensing discharge of the spark coil and for providing a pulse to the counter upon the occurrence of each discharge.

5. The control computer of claim 2 and further comprising means, driven by the engine, for resetting the counter at a predetermined time in each cycle of the engine.

6. The control circuitry of claim 5 wherein the means, driven by the engine for resetting the counter at a predetermined time in each cycle of the engine comprises: a sensor connected between the engine ignition distribution system and a selected igniter, operative to sense a firing pulse provided to that igniter, and a connection between the sensor and the counter.

7. The control computer of claim 1 wherein:

each channel is available for operation for a time duration of more than 80% of an engine cycle.

8. The control computer of claim 1 wherein said engine includes a manifold pressure sensor and an engine temperature sensor and connections between each of the computing channels and both of said last two sensors.

9. The control computer of claim 1 wherein all computing channels are operatively connected in common to said at least one engine porameter sensor.

10. In a fuel injection system for a multi-cylinder engine having one injector for each cylinder adapted to inject a fuel charge upon receipt of an electric pulse, igniter means associated with each cylinder for generation of firing pulses, a source of igniter power and a distributor operative to connect the source of igniter power sequentially to each of the igniters, the improvement of control computer for generating injector pulses to each of the injectors, comprising: a single multiple stage counter; means connected to the source of igniter power and the counter operative to increase the stage contained in the counter each time a firing pulse is provided to one of the igniters; and means controlled by the state of the counter for generating electrical pulses for all of the injectors.

11. The control computer of claim 10 wherein the engine has a predetermined number of cylinders, the injectors are arranged in a plurality of circuits, each circuit containing a predetermined number of injectors, and the computer has a number of channels equal to the ratio of the predetermined number of cylinders to the predetermined number of injectors.

* * * * *

UNITED STATES PATENT AND TRADEMARK OFFICE

CERTIFICATE OF CORRECTION

PATENT NO. : 4,058,709

DATED : November 15, 1977

INVENTOR(S) : E. David Long

It is certified that error appears in the above-identified patent and that said Letters Patent are hereby corrected as shown below:

Column 4, line 21, "sequentially one one of" should read -- sequentially on one of --.

Column 8, line 50, "patent application" should read -- Patent Application --.

Column 10, line 17, "valve" should read -- value --.

Column 11, line 53, "patent application" should read -- Patent Application --.

Column 11, line 56, "herewidth" should read -- herewith --.

Column 14, line 7, "patent application" should read -- Patent Application --.

Column 19, lines 53 & 54, delete "and the control computer includes output connections between Signed and Sealed this

*Sixth* Day of *June 1978*

[SEAL]

*Attest:*

RUTH C. MASON
*Attesting Officer*

DONALD W. BANNER
*Commissioner of Patents and Trademarks*